United States Patent [19]

Dalbo

[11] 4,391,370

[45] Jul. 5, 1983

[54] EMBROIDERY PROJECT ACCESSORY CARRYING CASE

[75] Inventor: Lorraine E. Dalbo, Atlanta, Ga.

[73] Assignee: Dal-Craft, Inc., Tucker, Ga.

[21] Appl. No.: 243,895

[22] Filed: Mar. 16, 1981

[51] Int. Cl.[3] ..... A45C 15/00; A45C 7/00

[52] U.S. Cl. ..... 206/574; 150/35; 190/43; 206/223; 206/227

[58] Field of Search ..... 206/223, 227, 231, 232, 206/373, 388, 472, 574; 223/106, 107; 190/42, 43, 51; 224/228; 150/34, 52 R, 35, 38, 30; 229/56

[56] References Cited

U.S. PATENT DOCUMENTS

| | | | |
|---|---|---|---|
| 214,003 | 4/1879 | Piper | 206/227 |
| 501,431 | 7/1893 | Lambert | 150/38 |
| 1,029,280 | 6/1912 | Davidson | 150/52 R |
| 1,209,870 | 12/1916 | Nathanson | 150/38 |
| 2,493,182 | 1/1950 | Beder | 150/35 |
| 4,296,945 | 10/1981 | Pavlik | 150/35 |

FOREIGN PATENT DOCUMENTS

| | | | |
|---|---|---|---|
| 1498629 | 9/1966 | France | 383/10 |
| 490902 | 2/1954 | Italy | 150/34 |
| 199905 | 7/1923 | United Kingdom | 150/34 |
| 813414 | 5/1959 | United Kingdom | 383/18 |

*Primary Examiner*—William T. Dixson, Jr.
*Assistant Examiner*—Brenda J. Ehrhardt
*Attorney, Agent, or Firm*—James B. Middleton

[57] ABSTRACT

An embroidery project accessory carrying case for conveniently transporting the materials for at least one embroidery or other needlework project. The carrying case has a flexible backing sheet with storage pockets at each end. One end of the backing sheet includes a main pocket and a secondary pocket with a single flap to close both pockets, these pockets being adapted to receive the tools and bulky items of needlework materials. The other end of the backing sheet includes a large pocket and a shallow pocket. The large pocket is adapted to receive pattern books and the like while the shallow pocket receives a supply of thread. Fastening devices are attached to the carrying case such that the backing sheet can be folded twice—into thirds—and fastening devices will hold the case in this condition; and, the backing sheet can be folded once—into half—and the fastening devices will hold the case in this condition. The case can be bent backwards or laid flat for access to the materials.

7 Claims, 9 Drawing Figures

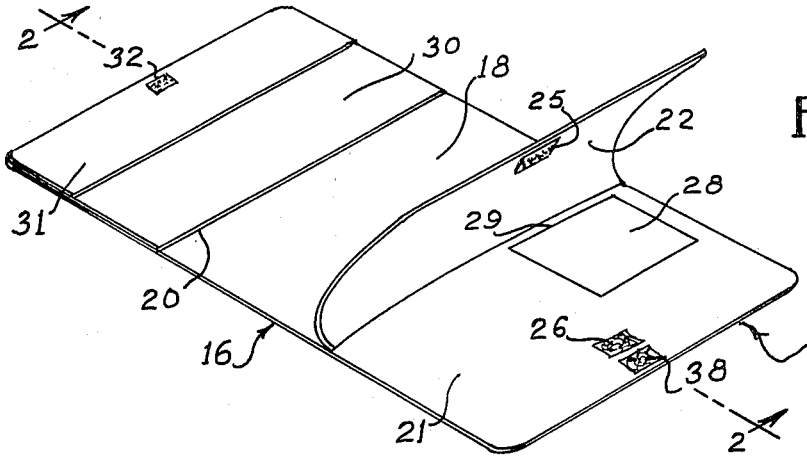
FIG. 1
FIG. 2
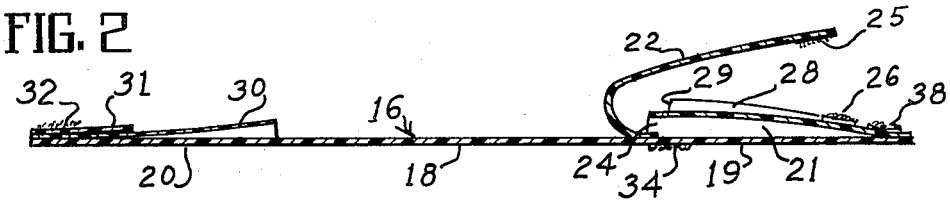
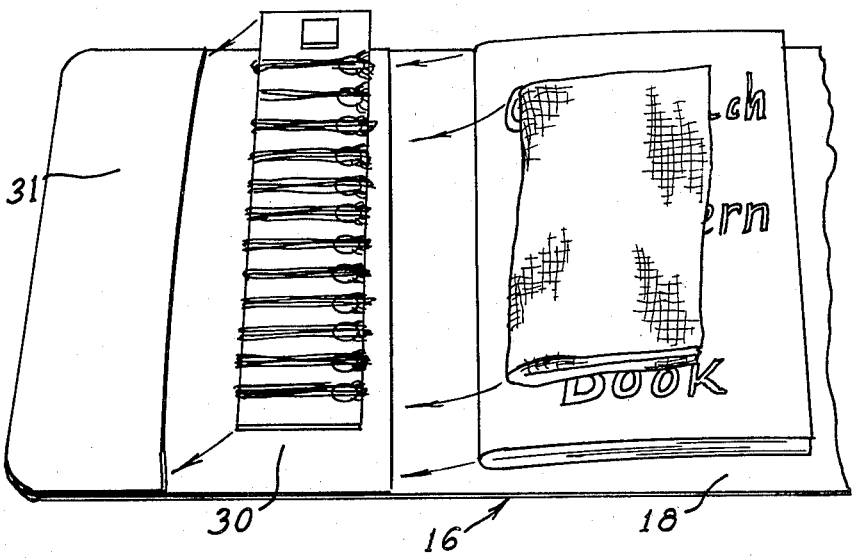
FIG. 3

FIG. 4
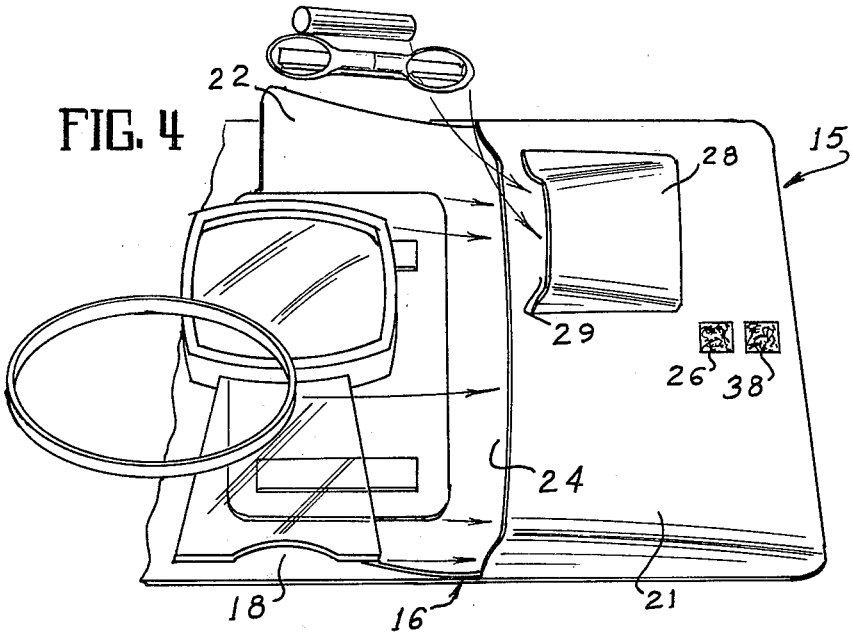
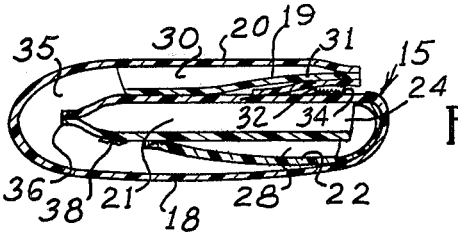
FIG. 5
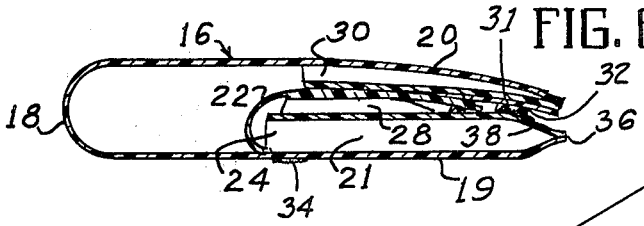
FIG. 6
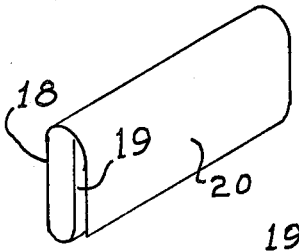
FIG. 7
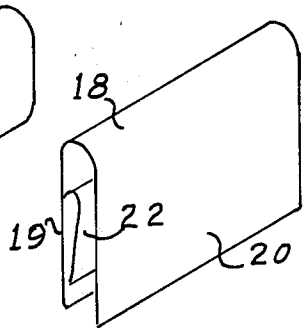
FIG. 8
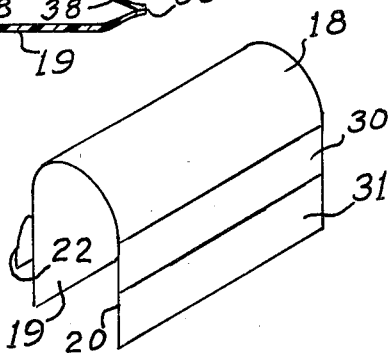
FIG. 9

EMBROIDERY PROJECT ACCESSORY CARRYING CASE

FIELD OF THE INVENTION

This invention relates generally to carrying cases and the like, and is more particularly concerned with a convenient and versatile carrying case adapted for carrying the materials required for at least one needlework project.

BACKGROUND OF THE INVENTION

In doing embroidery or other needlework designs, there is a rather large variety of materials necessary for even one project. For such crafts as cross-stitch, one generally requires a pattern board and a large magnifying glass in addition to the rather obvious materials including fabric, needles, scissors, perhaps a hoop, and several different colors of thread. Further, a person doing needlework will usually carry at least one pattern, perhaps several patterns, and maybe a book of patterns with some instructions. Thus, the usual paraphernalia is quite bulky and unhandy to transport.

The most common effort at making needlework materials portable is simply to use a large bag. The great variety of materials, including a number of skeins of yarn, is normally somewhat thrown into the bag, and materials as required are searched for in the resulting jumble.

Recently, there have been several efforts at organizing the great number of yarns required for needlework, and several devices are on the market. One such device is a thread organizer kit disclosed in the U.S. Pat. No. 4,264,011, issued on Apr. 28, 1981, to Dalbo et al. This kit will hold a very large variety of threads, all organized for easy retrieval, but the kit is not designed to contain any of the other materials used in needlework. As a result, there is a significant problem in carrying the materials for needlework projects.

Though a large bag will of course hold the materials necessary, one must rummage through the entire contents to find the item desired; and, if a person is in a small space such as a seat on commercial transportation, the unhandiness of the bag is especially evident. Also, the bag generally has no organizational means to maintain the materials in an orderly, useable state.

SUMMARY OF THE INVENTION

The present invention overcomes the above mentioned and other difficulties with the prior art by providing a carrying case for at least one needlework project, the carrying case comprising a backing sheet having a flexible center section, a first end section on one side of the center section and having at least one storage pocket, and a second end section on the opposite side of the center section and having at least one storage pocket. The flexibility of the center section allows the backing sheet to be folded in approximate thirds so that the center section effectively closes the storage pockets in both the first end section and the second end section. Alternatively the carrying case may be folded in half to dispose the storage pockets adjacent to each other; or, the device may be folded backwards to expose the pockets for use of the materials. Appropriate fastening means may be fixed to the carrying case of the present invention to fasten the case in the various positions as desired.

BRIEF DESCRIPTION OF THE DRAWINGS

These and other features and advantages of the present invention will become apparent from consideration of the following specification when taken in conjunction with the accompanying drawings in which:

FIG. 1 is a perspective view of one form of carrying case made in accordance with the present invention, showing the device laid flat;

FIG. 2 is a longitudinal cross-sectional view taken substantially along the line 2—2 in FIG. 1;

FIG. 3 is an enlarged perspective view of the left hand end of the device as shown in FIG. 2, and illustrating storage of conventional needlework materials;

FIG. 4 is a view similar to FIG. 3, but showing the right hand end of the device as illustrated in FIG. 2;

FIG. 5 is a cross-sectional view similar to FIG. 2 but showing the device folded in approximate thirds;

FIG. 6 is another cross-sectional view similar to FIG. 2 but showing the device folded approximately in half; and, FIGS. 7–9 are rather schematic views showing the various contemplated configurations of the device.

DESCRIPTION OF THE PREFERRED EMBODIMENT

Referring now more particularly to the drawings, and to that embodiment of the invention here chosen by way of illustration, it will be seen in FIG. 1 of the drawings that the carrying case generally designated at 15 includes a backing sheet 16. As here shown, the backing sheet 16 extends the full length and width of the case 15; however, as will be better understood hereinafter, the backing sheet 16 may be made in several different pieces and glued, heat-sealed, or otherwise fixed together. This becomes a matter of choice depending on the specific design aspects of the particular embodiment of the invention constructed.

The backing sheet 16 includes a flexible center section 18. In most of the configurations contemplated, the center section 18 is required to bend, so it is necessary that the center section be flexible. The center section 18 is here shown as formed integrally with a first end section 19 and a second end section 20. Each of the end sections 19 and 20 is provided with storage pockets which will be discussed below.

It is contemplated that, for a relatively inexpensive carrying case made in accordance with the present invention, the backing sheet 16, as well as other parts to be discussed hereinafter, will be made of vinyl or other flexible thermoplastic sheet material. With this in mind, no seams or the like are illustrated, it being understood that all joints and seams will be heat sealed as required. It should also be understood, however, that the device may be made of leather or virtually any other sheet material to give the appearance desired, and appropriate stitching, gluing or the like can be used in lieu of heat sealing.

Returning now to FIG. 1 of the drawings, with attention also to FIG. 2, it will be seen that the first end section 19 includes a pocket 21 which is substantially co-extensive with the end section 19. The pocket 21 is therefore quite large, and is intended to hold such items as a magnifying glass, hoops, pattern board, and similar large bulky items as is shown in FIG. 4.

Since the pocket 21 is designed to receive a number of bulky items, it is here shown as including a closure flap 22. The flap 22 is fixed to the backing sheet 16, and is flexible to overlap the opening 24 of the pocket 21. Appropriate fastening means are provided for the flap 22. As here shown, there is a hook and teazle fastening means, with the hook material 25 fixed to the flap 22 and the teazle material 26 fixed to the pocket 21.

The pocket 21 may further include a secondary pocket 28, best shown in FIGS. 1 and 4. The secondary pocket 28 is useful for smaller items that would be difficult to locate within the large pocket 21, such as the folding scissors and needle case illustrated in FIG. 4.

With the secondary pocket 28 located as illustrated, the opening 29 being adjacent to the opening 24, the flap 22 will effectively close both the large pocket 21 and the secondary pocket 28 when the flap is closed with the fastening means 25 and 26 engaged.

From the foregoing discussion it will be understood that the backing sheet 16 in the area comprising the end section 19 may be rather stiff if desired. However, when the section 19 is made of the same flexible material as the section 18 for economic reasons, the materials placed into the large pocket 21 will tend to keep the section 19 flat. Of course a pattern board or the like as illustrated in FIG. 4 is especially effective in keeping the end section 19 flat.

Turning now to the second end section 20, and looking at FIGS. 1, 2 and 3 of the drawings, it will be seen that the section 20 includes a pocket 30 which is substantially co-extensive with the end section 20. It is contemplated that this pocket 30 will receive such things as a pattern book, or a group of patterns, a piece of fabric or a project in process or the like.

In the embodiment of the invention here shown, there is a shallow pocket 31 overlying a portion of the pocket 30. In the Dalbo et al. U.S. Pat. No. 4,264,011 mentioned hereinabove, the kit disclosed includes a device referring to as a "project card" which is a narrow rectangular piece of material having means for receiving a plurality of yarns. The project card also includes a needle holder at one end. The object is to select the various yarns required for a single project and place a quantity of each yarn on the project card. Such a project card is admirably adapted to be received within the pocket 31 so a person will have a quantity of all yarns required for a project. Of course other thread storage means may also be used to carry a quantity of thread in the carrying case of the present invention.

With the foregoing construction in mind, attention is directed to FIG. 5 of the drawings which shows the carrying case folded approximately in thirds. Though the actual materials are not shown within the case in FIG. 5 the various parts of the case 15 are shown somewhat distended to illustrate the manner of use of the case.

Looking first at the pocket 21 on the end section 19, it will be seen that there is a large space within this pocket to illustrate the fact that large bulky items would be received within this pocket. The flap 22 is also shown in place closing both the opening 24 of the pocket 21 and the opening 29 in the pocket 28.

It should especially be noticed in FIG. 5 that the center section 18 of the backing sheet 16 is wrapped around the end section 19 so the center section 18 would effectively close the pockets 21 and 28. For this reason, the flap 22 may be omitted if desired when the case is to be used only as shown in FIG. 5.

In folding the case 15 as shown in FIG. 5, the center section 18 is continued around the end section 19 until the opposite end section 20 at least partially overlies the end section 19. There is a fastening means provided to hold the case 15 in this folded position. Again, any desired form of fastener may be used, but the hook and teazle is shown. There is hook material 32 fixed to the pocket 31, and this hook material is engageable with the teazle material 34 fixed to the back of the end section 19. Placement of the fastening means 32 and 34 is shown in FIGS. 1 and 2 of the drawings.

Especially with the hook and teazle material, it will be seen that the folding of the backing sheet 16 as illustrated in FIG. 5 can leave more or less storage space where indicated at 35. It will be realized, however, that the flexible center section 18 allows the storage space 35 to be large enough to accommodate, for example, a pattern book as shown in FIG. 3 of the drawings, since the storage space 35 is co-extensive with the pocket 30. The construction shown allows the book to fold around the extreme end 36 of the end section 19, thus taking a larger radius than if the book must be folded flat and inserted entirely within a pocket such as the pocket 30.

An alternative method of folding the case 15 is shown in FIG. 6 of the drawings, the case 15 being folded generally in half.

If the folding method shown in FIG. 6 is to be used, it will be noticed that little modification of the fastening means must be made. If the hook and teazle fastening means is used, the hook material 32 can be engaged with the teazle material indicated at 38. While the teazle material 38 is here shown as a separate piece, it will be recognized that the teazle material 26 can be slightly elongated, and one piece can serve both to fasten the flap 22 and to hold the case 15 folded as shown in FIG. 6.

When the folding as shown in FIG. 6 is utilized, the carrying case is of course somewhat larger than when the folding as shown in FIG. 5 is utilized; however, it will be seen that a book or the like can be inserted into the pocket 30 and the book will not be folded, This may be desirable in some circumstances simply to prevent folding of a pattern, and in other circumstances when the books are too thick to fold conveniently.

From the foregoing description it should now be seen that the carrying case of the present invention is highly versatile, and can conveniently carry all the materials needed for one or more needlework projects.

The case 15 can be folded generally in thirds to the configuration shown in FIG. 7, and the case is about like a conventional woman's purse in its size and convenience to carry. The fastening means 32 and 34 will hold the case 15 in this condition.

The case 15 can also be folded generally in half as shown schematically in FIG. 8 of the drawings. Fastening means 32 and 38 will hold the case closed, and one would probably use the flap 22 to close the pockets 21 and 28. While the case 15 is somewhat larger in this configuration, it will be seen that it would be well adapted for the addition of a handle in the middle so it could be carried as a brief case.

In any event, when the case 15 is to be used, one may open the case and bend the center section 18 backwards as shown in FIG. 9 of the drawings. In this condition, the case 15 can be hung over any convenient rest, such as the needleworker's leg, and all storage pockets are accessible for use of the materials therein.

Of course, when space permits, the device may be laid flat as shown in FIG. 1 to render all materials accessible.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. A carrying case for needlework materials including a backing sheet having an inside surface and an outside surface, said backing sheet comprising a flexible center section, a first end section at one side of said flexible center section and contiguous with said flexible center section, a second end section at the opposite side of said flexible center section and contiguous with said flexible center section, a first storage pocket carried by said inside surface of said first end section, and a second storage pocket carried by said inside surface of said second end section, said flexible center section being foldable adjacent to said storage pockets, said second end section being foldable towards said inside surface along a line adjacent to said second storage pocket after said first end section is folded towards said inside surface along a line adjacent to said first storage pocket so that said second end section is disposed with said inside surface of said second end section overlying said outside surface of said first end section, and fastening means to selectively retain said second end section in position over said first end section, said flexible center section having sufficient length to provide storage space between said inside surface of said flexible center section and said first storage pocket, said storage space being continuous with the inside of said second storage pocket.

2. A carrying case as claimed in claim 1, said first storage pocket being adapted to receive the bulky items of said needlework materials, and including a closure flap for closing said first storage pocket.

3. A carrying case as claimed in claim 2, and further including a secondary pocket carried by said first storage pocket, said secondary pocket being beneath said closure flap so that said closure flap closes both said first storage pocket and said secondary pocket.

4. A carrying case as claimed in claim 3, and including fastening means comprising a plurality of first fastener parts and a plurality of second fastener parts engageable with each other, one first fastener part of said plurality of first fastener parts being desposed on said inside surface of said second end section, one second fastener part of said plurality of second fastener parts being disposed on said outside surface of said first end section, said one first fastener part and said one second fastener part constituting said fastening means to selectively retain said second end section in position over said first end section and being so located as to be engageable to hold said second end section in position overlying said first end section.

5. A carrying case as claimed in claim 4, and further including another first fastener part on said closure flap for retaining said closure flap in position to close said first storage pocket.

6. A carrying case for needlework materials including a backing sheet having an inside surface and an outside surface, said backing sheet comprising a flexible center section, a first end section at one side of said flexible center section and contiguous with said flexible center section, a second end section at the opposite side of said flexible center section and contiguous with said flexible center section, a first storage pocket carried by said inside surface of said first end section, and a second storage pocket carried by said inside surface of said second end section, said flexible center section being sufficiently flexible to be selectively foldable adjacent to said storage pockets and at a selected line between said storage pockets, said flexible center section being foldable towards said inside surface successively along a line adjacent to said first end section and along a line adjacent to said second end section so that said backing sheet is folded generally in thirds, and said flexible center section is further selectively foldable generally in half to enclose said storage pockets with said storage pockets substantially juxtaposed, and generally in half to expose pockets, said carrying case further including fastening means for holding said carrying case in the selected position when said backing sheet is folded in thirds, and additional fastening means for holding said carrying case in the selected position when said backing sheet is folded generally in half to enclose said storage pockets.

7. A carrying case as claimed in claim 6, and including fastening means comprising a plurality of first fastener parts and a plurality of second fastener parts engageable with each other, one first fastener part of said plurality of first fastener parts being disposed on said inside surface of said second end section, one second fastener part of said plurality of second fastener parts being disposed on said outside surface of said first end section, said one first fastener part and said one second fastener part constituting said fastening means for holding said carrying case in the selected position when said backing sheet is folded in thirds and being so located as to be engageable to hold said second end section in position overlying said first end section, and further including another second fastener part carried by said inside surface of said first end section, said one first fastener part and said another second fastener part constituting said additional fastening means, said one first fastener part being selectively engageable with said one second fastener part when said backing sheet is folded in thirds and with another second fastener part when said backing sheet is folded in half to enclose said storage pockets.

* * * * *